United States Patent [19]

Hess et al.

[11] 4,235,046

[45] Nov. 25, 1980

[54] WINDOW OPERATING MECHANISM

[75] Inventors: Hans-Peter Hess, Coburg; Wolfgang Schultheiss, Frohnlach, both of Fed. Rep. of Germany

[73] Assignee: Metallwerk Max Brose GmbH & Co. KG, Coburg, Fed. Rep. of Germany

[21] Appl. No.: 958,402

[22] Filed: Nov. 7, 1978

[30] Foreign Application Priority Data

Nov. 14, 1977 [DE] Fed. Rep. of Germany ..... 2750904

[51] Int. Cl.[2] ..... E05F 11/48

[52] U.S. Cl. ..... 49/352; 74/501.5 R

[58] Field of Search ..... 49/352; 254/175, 175.3, 254/172; 74/501.5, 242.1 TA, 242.11 C, 242.11 E

[56] References Cited

U.S. PATENT DOCUMENTS

| | | | |
|---|---|---|---|
| 1,606,712 | 11/1926 | McArthur | 49/352 X |
| 1,805,326 | 5/1931 | Bunker et al. | 74/242.11 C |
| 3,281,991 | 11/1966 | Colell | 49/352 |
| 3,444,649 | 5/1969 | Rivolier | 49/352 |
| 4,090,329 | 5/1978 | Rampel | 49/352 |
| 4,108,013 | 8/1978 | Sragal | 74/242.11 C |
| 4,109,417 | 8/1978 | Fogarollo | 49/352 |
| 4,145,934 | 3/1979 | Sragal | 74/242.11 C |

FOREIGN PATENT DOCUMENTS

| | | | |
|---|---|---|---|
| 2616331 | 3/1977 | Fed. Rep. of Germany | 49/352 |

*Primary Examiner*—Philip C. Kannan

*Attorney, Agent, or Firm*—Toren, McGeady and Stanger

[57] ABSTRACT

An operating mechanism for the window in a motorcar door and the like includes guiding devices, including at least one deflecting element, which engage a wire, cable or other elongated tension member and guide the tension member on the door in a loop-shaped path when the tension member is driven in the path alternatively in two opposite, longitudinal directions. The motion of the tension member is transmitted to the window. The tension member stretches under the longitudinal stresses exerted thereon by the drive and the window and needs to be tensioned. According to the invention, a spring in a permanently stressed condition biases the deflecting element in a direction to lengthen the path of the tension member and for thereby compensating for slack in the engaged portion of the tension member when the tension member moves in one longitudinal direction, whereby the spring reaches a partly relaxed condition. A protecting mechanism protects the spring against return from the partly relaxed condition toward the stressed condition when the tension member moves in the opposite direction.

10 Claims, 7 Drawing Figures

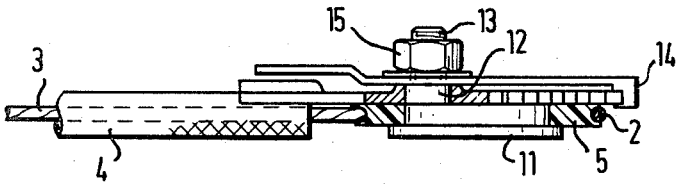
Fig. 3
Fig. 5
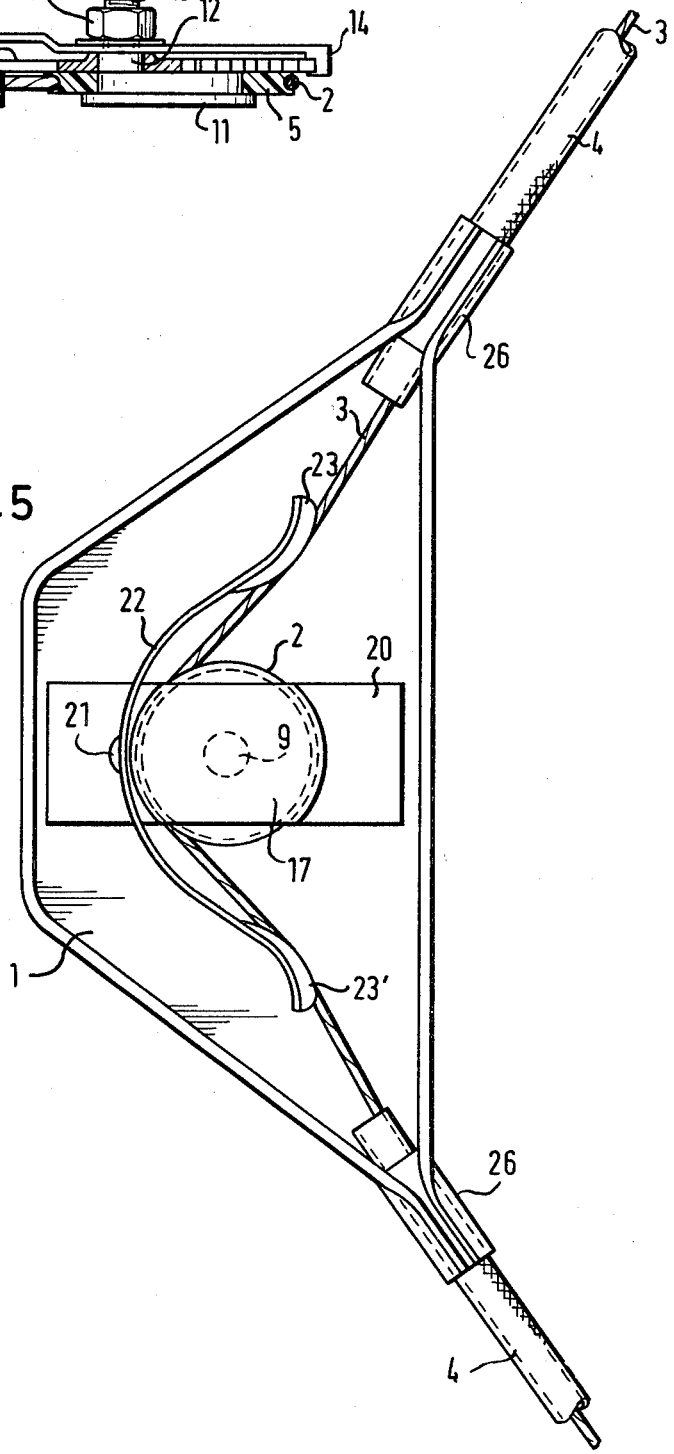

WINDOW OPERATING MECHANISM

This invention relates to window operating mechanisms of the type employed for raising and lowering windows in automobile doors and the like, and particularly to a window operating mechanism provided with an improved tensioning mechanism for the cable or other tension member employed in many window operating mechanisms for raising and lowering the window.

It is known from U.S. Pat. Nos. 3,444,649 and 4,090,329, for example, to guide a wire, cable, or other tension member on the supporting door structure in a loop-shaped path, movement of the cable being brought about by a hand crank or an electric motor turning a cable drum alternatively in two opposite directions, and the resulting movement of the cable is transmitted to the operated window by a bracket and/or other motion transmitting devices. The portion of the cable which pulls the window up is tensioned between the cable drum and the bracket, and the other cable portion is slack. During lowering of the window, the first-mentioned cable portion is slack while the other cable portion is tensioned by the frictional resistance of the window to downward movement. The cable stretches gradually under the applied stresses. An overly slack cable may knock against the door panels which amplify the resulting noise. Further stretching may cause the cable to leave grooves in guide pulleys and run over shafts and other fixed elements so that it wears out soon.

The problem is well known, and provisions have been made for keeping the cable or other tension member taut. In the first-mentioned earlier patent, the cable is guided in rigid conduits sequentially connected by a compression spring which lengthens the loop-shaped cable path as the cable stretches. The last-mentioned, commonly owned patent employs flexible cable sheaths and a compression spring interposed between one end of the sheath and fixed supporting structure for the same purpose.

As explained above, each cable portion in a conventional window mechanism of the type discussed is alternatingly stressed in tension and relaxed, and associated tensioning springs undergo the same cycle. The more a cable stretches, the less the associated tensioning spring is stressed during one half of the cycle, and the less tensioning of the cable can it offer when the associated cable portion is again relaxed in the next half operating cycle. Ultimately, the spring ceases to perform a useful function.

It is a primary object of this invention to keep a cable tensioning spring in a window operating mechanism under more uniform stress while the cable or other tension element stretches, and thereby to extend the useful life of the window operating mechanism between overhauls for shortening or replacing the tension member.

Other features, additional objects, and many of the attendant advantages of this invention will readily be appreciated as the same becomes better understood from the following detailed description of preferred embodiments when considered in connection with the appended drawings in which:

FIG. 3 is a top plan view, partly in section, of the device of FIG. 2;

FIG. 5 shows another portion of the mechanism of FIG. 1 on a larger scale in side elevation;

Figure 1:
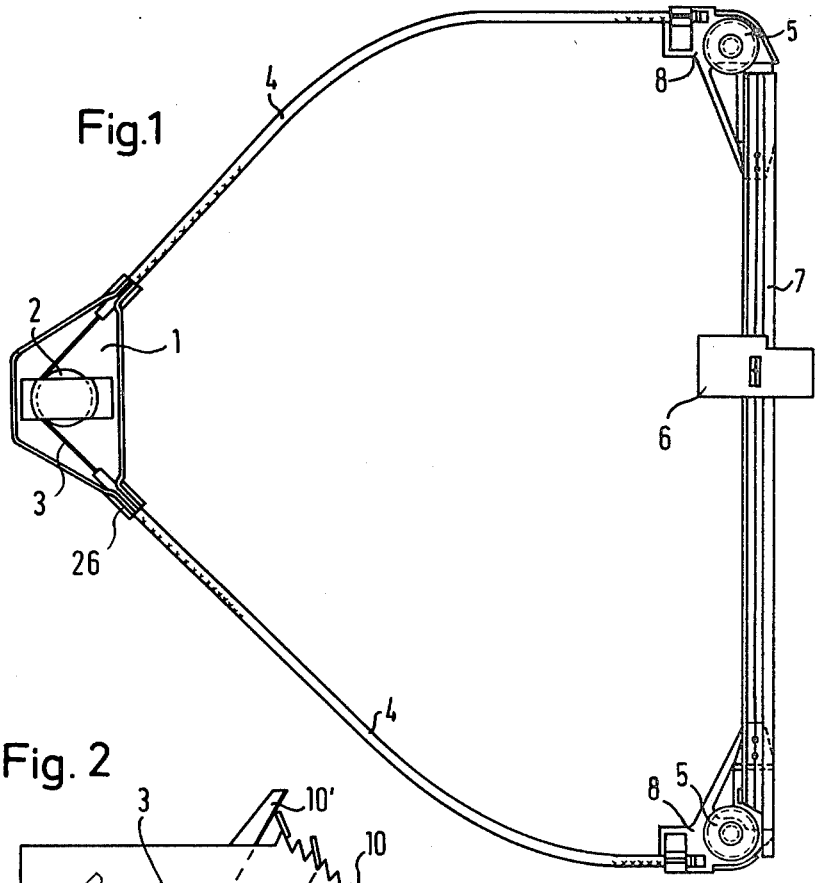
FIG. 1 shows the basic structure of a window operating mechanism of the invention in side-elevation.

Referring initially to FIG. 1, there is shown as much of a windowed vehicle door as is needed for an understanding of the invention, the non-illustrated parts of the door and of the window operating mechanism being well known from the two cited patents.

A trapezoidal mounting plate 1 is integral with or otherwise fixedly fastened to an inner door panel, not otherwise shown, on which the entire window operating mechanism is supported. It carries a cable drum 2 on which a steel cable 3 is wound in several tight turns. Two flexible bowden sheaths 4 are fastenend to the mounting plate 1 in tubular plate sections 26, and their other ends are similarly attached to two vertically spaced, approximately triangular mounting plates 8 on the door which carry respective grooved pulleys 5. The two ends of the cable 3 pass from the cable drum 2 through respective sheaths 4 and are trained over the pulleys 5 to a bracket 6 slidably mounted on a guide rail 7. The bracket 6 transmits the motion of the cable 3 to a window attached to the bracket, as is conventional and not specifically illustrated.

Figure 2:
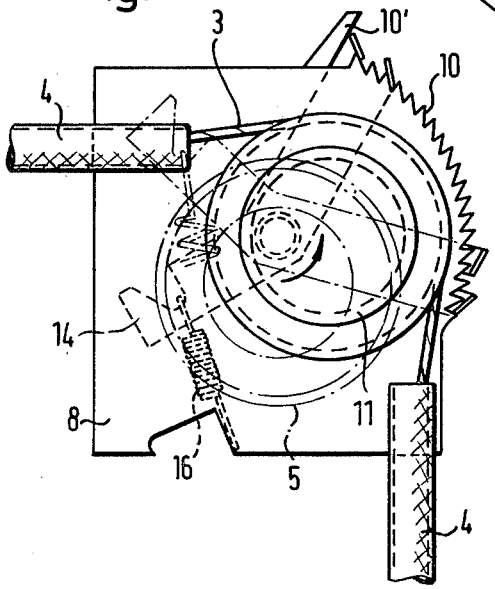
FIG. 2 illustrates a portion of the mechanism of FIG. 1 on a much larger scale.
Figure 4:
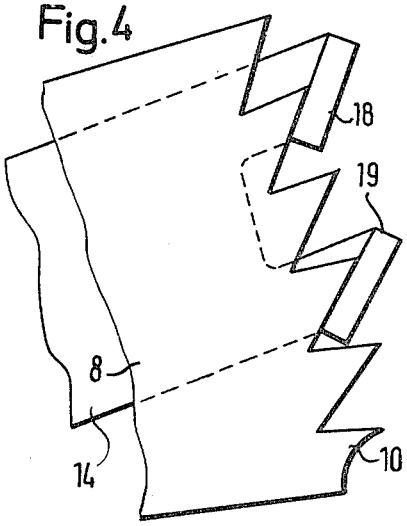
FIG. 4 shows a portion of the device of FIG. 2 on a further enlarged scale.

As is better seen in FIGS. 2 to 4, a circularly arcuate edge of the upper mounting plate 8 is saw-toothed and constitutes a ratchet. An abutment 10' projects beyond the saw teeth at the upper end of the ratchet 10. The pulley 5 consists of plastic and is annular. It is mounted rotatably on a circular metallic crank disk 11. A crank shaft 12 eccentrically projecting from the disk 11 is journaled in the mounting plate 8 so that the axes of rotation of the shaft 12 in the mounting plate 8 and of the pulley 5 on the disk 11 are parallel, but radially spaced from each other.

The free end portion 13 of the shaft 12 is threaded. A two-armed sheet-metal rocker 14 is clamped fast between the shoulder of the shaft separating the smoothly cylindrical part from the threaded part 13 by a nut 15. A helical tension spring 16 is hooked into a notch of the shorter rocker arm and to the plate 8 and tends to turn the rocker 14, the crank shaft 12, and the crank disk 11 counterclockwise, as indicated by an arrow in FIG. 2, from the position of the pulley 5 and disk 11 indicated in chain-dotted lines toward that shown in fully drawn lines.

Two lugs 18, 19 integrally projecting from the free end of the longer rocker arm are angularly offset in such a manner as to constitute somewhat flexible pawls cooperating with the ratchet 10 as is evident from FIG. 4. The teeth of the ratchet 10 are uniformly spaced, and the two pawls 18, 19 are spaced approximately one-and-one-half times one tooth spacing so that the pawl-and-ratchet device may block clockwise rotation of the pulley 5 in steps of one-half tooth spacing. Any other spacing of the pawls 18, 19 by an integral multiple of one tooth spacing plus a fraction of such a spacing may be chosen to produce the same or a closely analogous result, the term integral multiple including the illustrated arrangement.

When the window operating mechanism is first assembled, the cable 3 is cut to a length to hold the pulley in the position shown in FIG. 2 in chain-dotted lines. The spring 16 is stressed to its greatest length, and the pawls 18, 19 are located near the lowermost teeth of the ratchet 10. When the cable portion illustrated in FIGS. 2 and 3 is tensioned by the rotating cable drum 2 and the resistance of the non-illustrated window to lifting movement, the pawl-and-ratchet device holds the pulley 5 in its initial position. If the cable 3 stretches under the lifting stress, the illustrated cable portion becomes slack during the next window lowering operation in which the lower cable portion is tensioned. The slack in the cable is taken up by the spring 16 turning the crank assembly 11, 12, 14 toward the fully drawn position and thereby relaxing somewhat. The pawls 18, 19 slide upward over as many ratchet teeth as may be possible and prevent later clockwise movement of the crank assembly and the resulting return of the spring 16 from its partly relaxed condition toward the more stressed initial condition.

The above description of a first cycle of window operation is based on the assumption that the cable 3 was not adequately pre-stressed before being installed. Actually, angular movement of the crank assembly by even one half tooth spacing of the pawl-and-ratchet device will not occur in a properly assembled mechanism for many window lifting and lowering cycles, and will repeat thereafter so infrequently that the fully contracted condition of the spring 16 and the corresponding position of the pulley 5, drawn in full lines, will be reached only after years of quiet and smooth operation.

The spring 16 remains under a stress which gradually diminishes until its several turns abuttingly engage each other. It biases the pulley 5 in a direction to lengthen the loop-shaped path of the cable 3 and for thereby compensating for slack in the cable portion engaged by the pulley when the cable moves longitudinally in the window lowering direction. The resulting partial relaxation in the spring is maintained by the pawl-and-ratchet device 10, 18, 19 when the cable moves in the window lifting direction. As is not specifically illustrated, the lower mounting plate 8 and guide pulley 5 are equipped with a crank assembly and spring in a manner obvious from the above description of FIGS. 2–4.

Additionally, a functionally analogous, but structurally different tensioning device is associated with the cable drum 2. As is better seen in FIG. 5, the cable drum is mounted on a drive shaft 9 journaled in the mounting plate 1 and connected either to a manually operated crank or to the rotor of an electric motor on the far side of the panel 1, as is conventional and not specifically shown. The drum 2 is partly covered by a strap 20 of sheet metal whose two ends are fixedly fastened to the mounting plate, and whose center portion is offset to provide a partly cylindrical receptacle 17 for the drum 2 and the several turns of the cable 3 which are wound on the drum.

The longitudinally central portion of a leaf spring 22 is secured between a pin 21 projecting from the strap 20 and an outer, cylindrically arcuate face of the receptacle 17 with sufficient clearance to permit limited pivoting movement of the spring 22 in a plane parallel to that of FIG. 5. Plastic pads 23, 23' on the two free ends of the spring 22 are grooved slidably to receive respective portions of the cable 3 extending from the drum 2 toward the two bowden sheaths 4. The spring 22, when relaxed, contracts into the approximate shape of a closed circle, and it therefore biases the cable-engaging pads 23, 23' in a direction to lengthen the path of the cable 3 between the drum 2 and the two sheaths 4.

When the window is lifted by counterclockwise rotation of the drum 2, the resulting tension in the upwardly extending cable portion tends to pivot the spring 22 counterclockwise, as viewed in FIG. 5. When the lower cable portion is tension during lowering of the window, any slack in the upper cable portion is taken up by partial relaxation in the spring 22, but the spring is protected against return to its initially stressed condition when the upper cable portion is again tensioned by its pivoting capability, and the resulting even distribution of the combined stresses in the two cable portions between the two arms of the spring 22 leads to a continuous, gradual relaxation of the stress in the spring 22 in very small increments without intermediate returns to a more stressed condition under the working tension of the cable 3.

The plastic pads 23, 23' have been found to wear very slowly and not to cause any wear of the steel cable 3. The spring 22 and associated elements were omitted from FIG. 1 because of the smaller scale of that Figure. If expected operating conditions warrant, the tensioning device of FIG. 5 may be employed to the exclusion of the devices associated with the pulleys 5, or only one of the latter devices may be employed with or without the tensioning mechanism illustrated in FIG. 5.

Figure 6:
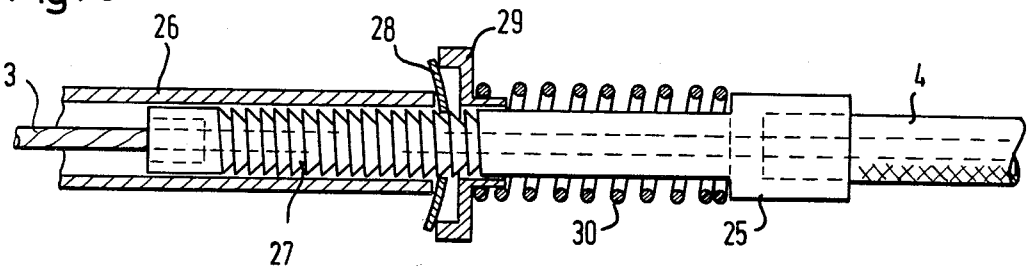
FIG. 6 illustrates a cable tensioning device for supplementing the device of FIG. 5 in a fragmentary, sectional view on a larger scale.

Another device similar to that of FIG. 2 may be employed at the mounting plate 1 to replace or to supplement the action of the spring 22 as is shown in FIG. 6. Only the tubular section 26 of the mounting plate 1 is seen. The associated end of a bowden cable 4 is fixedly fastened in an enlarged head of a coaxial tubular rod 25. The rod is partly received in the tubular mounting plate section 26, and the received part of the rod 25 is formed with a helical groove 27 of an asymmetrical V-section to define a ridge shaped in the manner of the teeth in the ratchet 10. A helical compression spring 30 is coiled about the part of the rod 25 outside the tubular section 26. It abuts against the head of the rod 25 and a radially flanged, rigid washer 29. A dished spring clip 28 is fixedly held against the free end of the tubular section 28 by the washer 29 under the biasing force of the spring 30. The aperture of the clip is dimensioned for pawl-like cooperation with the ridge 27 on the rod 25.

The spring 30 tends to increase the effective length of the cable path when slack in the cable 3 permits the bowden sheath 4 to be pushed away from the tubular section 26. During subsequent tensioning of the illustrated cable portion, stressing of the spring 30 is prevented by the pawl-and-ratchet device 27, 28.

Figure 7:
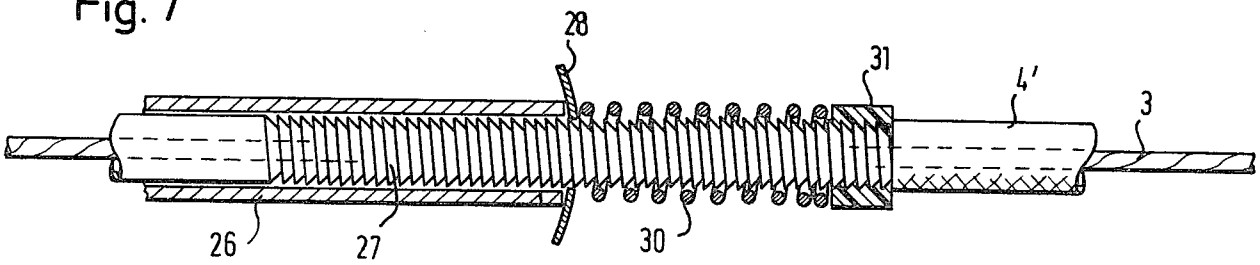
FIG. 7 is an analogous view of a variation of the device of FIG. 6.

In the closely analogous device shown in FIG. 7, the tubular rod 25 is replaced by a unitary section of a modified bowden sheath 4'. A helical groove 27 is cut into the sheath section received in the tubular mounting plate section 26. Internal threads in a plastic bushing 31 engage the groove 27, and the bushing is longitudinally secured on the sheath 4' by abutting against a shoulder of the sheath at which the grooved section terminates. A spring clip 28 is held fast against the annular end face of the section 26 by a helical compression spring seated on the bushing 31 and the clip 28 to cause a mode of operation identical with that of the device of FIG. 6.

It should be understood, of course, that the foregoing disclosure relates only to presently preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. In a motor vehicle window lifting mechanism including a cable drum, a cable wound about said drum, a Bowden cable sheath for guiding cable provided from said drum over a looped path, means for driving said drum so that said cable can be moved in either direction through said looped path, a drive member fixed to said cable for transmitting movement to a window to be operated, and a guide rail for guiding said drive member, the improvement comprising tensioning means for compensating for variations produced in the length of said cable when said cable is stressed, said tensioning means including a deflecting element which directly engages said cable and is mounted for movement relative to said sheath for applying compensating tension to said cable, and blocking means associated with said tensioning means for countering movement of said deflecting element in a direction in which tension applied to said cable by said tensioning means is released.

2. In a mechanism as set forth in claim 1, said tensioning means including a spring for biasing said element to tension said cable, and said blocking means includes means for blocking movement of said deflecting element in a direction to counter the biasing force of said spring.

3. In a mechanism as set forth in claim 2, said blocking means including a pawl-and-ratchet mechanism.

4. In a mechanism as set forth in claim 3, said deflecting element being rotatable and having an arcuate, circumferential face, said cable being trained over said face.

5. In a mechanism as set forth in claim 4, further including a support and a crank journaled in said support for angular displacement about a first axis, said deflecting element being mounted on said crank for rotation about a second axis spaced from said first axis and extending in a common direction therewith, said spring biasing said crank to move angularly in one direction, said pawl-and-ratchet mechanism being operatively interposed between said support and said crank for preventing angular movement of said crank in the opposite direction.

6. In a mechanism as set forth in claim 5, said support including a mounting plate having a serrated edge constituting a ratchet in said pawl-and-ratchet mechanism, a lever fixedly mounted on said crank carrying a pawl of said pawl-and-ratchet mechanism.

7. In a mechanism as set forth in claim 6, said ratchet including a plurality of teeth having free end portions uniformly spaced from each other, two lug portions of said lever constituting respective pawls offset from each other a distance greater than an integral multiple of the uniform spacing of said end portions by a fraction of said uniform spacing.

8. In a mechanism as set forth in claim 3, said deflecting element including a flexible, elongated, tubular sheath receiving said cable therein for said longitudinal movement, and a support for guiding said cable, said spring being longitudinally interposed between said sheath and said support for biasing said sheath away from said support, and said pawl-and-ratchet mechanism being interposed between said sheath and said support.

9. In a mechanism as set forth in claim 8, said pawl-and-ratchet mechanism including a longitudinal row of annular ratchet teeth fastened to said sheath, and a resilient pawl element on said support engaging said ratchet teeth.

10. In a mechanism as set forth in claim 1, wherein said tensioning means includes a support and a pulley member mounted on said support for rotation about an axis, and said deflecting element comprises an elongated, stressed leaf spring having two longitudinally terminal portions and a central portion integrally connecting said terminal portions, said leaf spring including a pad on each of said terminal portions for engaging portions of said cable, said blocking means including means for pivotally mounting said central portion on said support thereby protecting said leaf spring against rotation from a partly relaxed condition toward a fully stressed condition.

* * * * *